United States Patent [19]

Seggerson

[11] Patent Number: 4,977,698

[45] Date of Patent: Dec. 18, 1990

[54] DISPLAY SIGN SYSTEM

[75] Inventor: Patrick J. Seggerson, Villa Hills, Ky.

[73] Assignee: Dualite, Inc., Williamsburg, Ohio

[21] Appl. No.: 365,242

[22] Filed: Jun. 12, 1989

[51] Int. Cl.[5] ..... G09F 13/04

[52] U.S. Cl. ..... 40/618; 40/564; 40/576

[58] Field of Search ..... 40/618, 576, 564

[56] References Cited

U.S. PATENT DOCUMENTS

| | | | |
|---|---|---|---|
| 1,146,528 | 7/1915 | Schilling | 40/618 |
| 1,779,190 | 10/1930 | Send | 40/618 |
| 2,624,141 | 1/1953 | Martin | 40/618 |
| 3,230,652 | 1/1966 | McNair | 40/618 |
| 3,315,392 | 4/1967 | Edwards | 40/143 |
| 3,458,945 | 8/1969 | Edwards | 40/140 |
| 3,742,633 | 7/1973 | Palm | 40/618 |
| 3,753,306 | 8/1973 | Hemgren | 40/618 |
| 3,835,307 | 9/1974 | Johnston | 40/564 |
| 4,367,604 | 1/1983 | Porter | 40/564 |
| 4,682,430 | 7/1987 | Ramsay | 40/5 |
| 4,693,026 | 9/1987 | Callahan et al. | 40/576 |
| 4,765,080 | 8/1988 | Conti | 40/576 |
| 4,817,316 | 4/1989 | Walker | 40/576 |

FOREIGN PATENT DOCUMENTS

| | | | |
|---|---|---|---|
| 8798 | 8/1933 | Australia | 40/564 |

*Primary Examiner*—Victor N. Sakran
*Attorney, Agent, or Firm*—Frost & Jacobs

[57] ABSTRACT

In accordance with one aspect of the present invention, there is provided an improved display sign system including a sign face and a plurality of vertically spaced longitudinal ribs defining tracks located on the sign face. The longitudinal tracks are designed to support indicia elements adjacent the sign face. In a preferred embodiment, the sign system further includes two side frame members disposed on opposite lateral sides of the sign face, each including a curved surface which is substantially flush with the sign face at its lateral side edge. The curved surface extends outwardly and away from the lateral side of the sign face to provide a guide for inserting indicia elements within a longitudinal track from the front side edges of the sign.

15 Claims, 3 Drawing Sheets

DISPLAY SIGN SYSTEM

TECHNICAL FIELD

This invention relates to display sign systems for use in restaurants and the like used for advertising menu items and price information, and, more particularly, to an improved sign system having a plurality of vertically spaced longitudinal tracks disposed on a sign face designed to support indicia elements adjacent that face, and including one or more oppositely disposed side frame members having a curved surface substantially flush with the planar sign face at the lateral sides of that face to facilitate insertion of indicia elements into the longitudinal tracks from the front side edges.

BACKGROUND ART

The use of interchangeable display sign systems is widespread in a variety of retailing industries, and is especially prevalent in restaurant and similar establishments where various items and their prices are subject to change on a relatively frequent basis. In many restaurants, a display sign system is often arranged adjacent a service counter where items are ordered, paid for, and delivered to the customer. Generally, these sign systems are backlighted with light sources mounted within the sign itself, while product and price information and similar indicia is provided as translucent characters and/or images on an otherwise opaque background. Light passes through the characters and illuminates the information in contrast to its opaque surroundings.

Examples of illuminated display signs are seen in U.S. Pat. No. 3,742,633 which issued to Bernhard Palm, and U.S. Pat. No. 3,458.945 which issued to L. N. Edwards. The Palm reference describes an illuminated display sign which includes individual characters which are placed between vertically spaced longitudinal rails. The rails are formed with a shallow channel and a deeper channel to enable insertion and removal of individual sign characters by sliding the same inwardly into the deeper channel until the character clears the upper portions of the lower rail, then pivoting the character inwardly toward the sign panel and sliding the lower end into the shallow groove. The insertion and removal of individual characters requires a rather intricate set of manipulations, requiring additional labor and time to achieve sign changes. Moreover, this arrangement requires the use of a biasing means to maintain adjacent characters in a tight relationship to prevent leakage of light between the individual characters, making insertion and removal of those characters more awkward and inconvenient.

The Edwards reference describes a display sign having a plurality of longitudinal protuberances designed to receive clips which support display indicia, as shown in the earlier Edwards U.S. Pat. No. 3,315,392. Such a mounting system for indicia is not contemplated for use in backlighted applications, however, as light leakage between adjacent indicia characters would be unacceptable. Furthermore, the use of the protuberance/clip support arrangement for the indicia characters is unduly complex, unwieldy and inefficient for display signs having a relatively large amount of information and indicia characters to be supported.

U.S. Pat. No. 4,367,604, which issued to Steven T. Porter, II, on Jan. 11, 1983, is directed to a backlighted menu board which has a plurality of vertically spaced ribs on the outer surface of its sign panel, and discusses the use of information strips which are insertable between the ribs. Porter further describes the provision of a plurality of picture display units which can be easily engaged with the flanges of two ribs of the sign, and which can be changed without dismantling a major portion of the sign. However, Porter requires that the lateral edges of its spaced ribs be substantially exposed to enable insertion or removal of its information strips therefrom. These exposed edges can allow undesirable leakage of light from the menu board.

Similar problems are encountered in sign systems as disclosed in U.S. Pat. No. 4,693,026, which issued to D. Callahan et al. on Sept. 15, 1987, and U.S. Pat. No. 4,765,080, which issued to W. Conti on Aug. 23, 1988. Both of these signs require insertion and/or removal of their letter panels from lateral side edges. Although the Callahan device includes a border member to minimize light leakage along its lateral edge, both of these changeable display devices require at least partial dismantling of the apparatus in order to change the information displayed thereon. As mentioned, because display signs of this type are often preferably mounted in close proximity to service counter areas critical to the operation of a restaurant or similar business, display signs requiring substantial labor and/or dismantling of the sign system are inefficient and obtrusive.

U.S. Pat. No. 4,682,430 which issued to Charles Ramsey on July 28, 1987, is an example of a removable price chip support arrangement designed to minimize light leakage. The price chip strip itself supports a plurality of individual price chips (i.e. 5) by providing a series of price chip receptor pockets fixedly attached adjacent one another. The strip is designed to be inserted between a pair of guide tracks mounted on the rear surface of a transparent frame panel which is provided on its front face with an opaque mask which defines elongated clear panels for display of the price chip indicia held within the price chip support strip. However, it is necessary to withdraw the price chip support strip from the support frame tracks to obtain access to the individual price chips held there within. Consequently, additional labor is required when changes are desirable, as the price chip support strip must be removed from the sign system. Moreover, because the support tracks are located on the rear face of the sign panel, access to the rear of the sign is required, further complicating sign change procedures, and often requiring the sign to be partially dismantled or opened.

Consequently, with sign systems heretofore available in the industry, it has been necessary to compromise the minimization of light leakage in an effort to provide access to the system for placing, removing, or otherwise changing information displayed thereon. Prior attempts to provide front access for changing the displayed information required complex structures and/or inconvenient manipulation of the indicia elements and other sign components, or compromised the light containment ability of the sign system, thereby diminishing the quality of the sign system and the efficiency of its use. Information changing procedures commonly interfered with business operations and added to the cost of operation through increased labor and capital outlays.

DISCLOSURE OF THE INVENTION

It is an object of this invention to obviate the above-described problems and shortcomings of the display sign systems heretofore available in the industry.

It is another object of the present invention to provide an improved display sign system which enables convenient front access to sign indicia while at the same time providing improved light containment.

It is also an object of the present invention to provide a display sign system including a sign face having a plurality of vertically spaced longitudinal tracks located thereon, and providing uniquely curved side frame members adjacent the sign face which facilitate insertion of indicia elements between the tracks from the front side edges thereof.

In accordance with one aspect of the present invention, there is provided an improved display sign system including a sign face and a plurality of vertically spaced longitudinal tracks disposed on that sign face. The longitudinal tracks are designed to support indicia elements adjacent the sign face. The sign system further includes a pair of side frame members disposed on opposite lateral sides of the sign face, each including a curved surface which is substantially flush with the sign face at its lateral sides The curved surface extends outwardly and away from the lateral sides of the sign face to provide a guide for inserting indicia elements between two spaced tracks from the front side edges of the sign.

BRIEF DESCRIPTION OF THE DRAWINGS

While the specification concludes with claims particularly pointing out and distinctly claiming the present invention, it is believed the same will be better understood from the following description taken in con with the accompanying drawings in which:

DETAILED DESCRIPTION OF THE INVENTION

Figure 1:
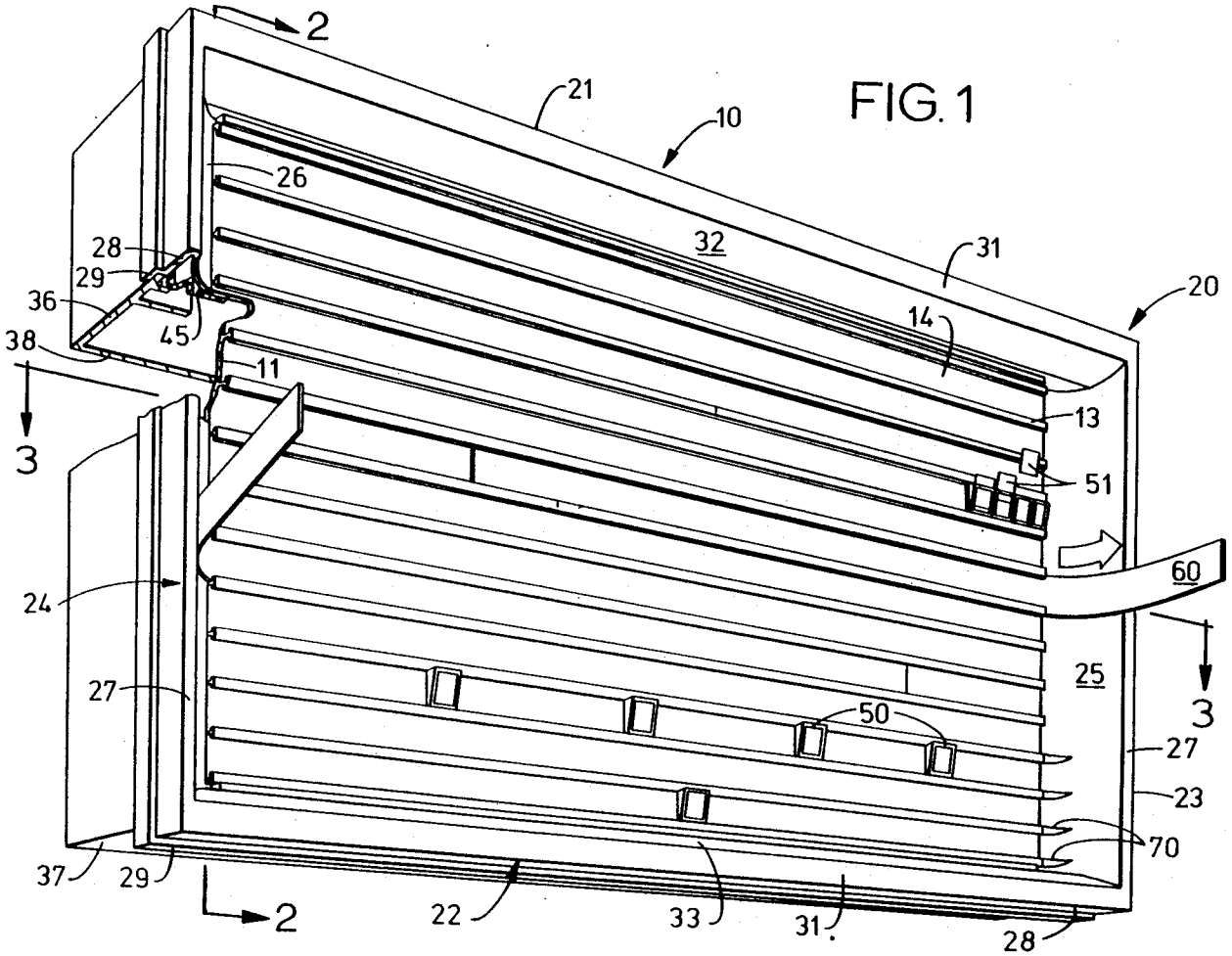
FIG. 1 is a perspective view of a preferred embodiment of a display sign system made in accordance with the subject invention.

Referring now to the drawings in detail, wherein like numerals indicate the same elements throughout the views, FIGS. 1–4 illustrate a preferred embodiment of a display sign system 10 of the present invention.

Figure 2:
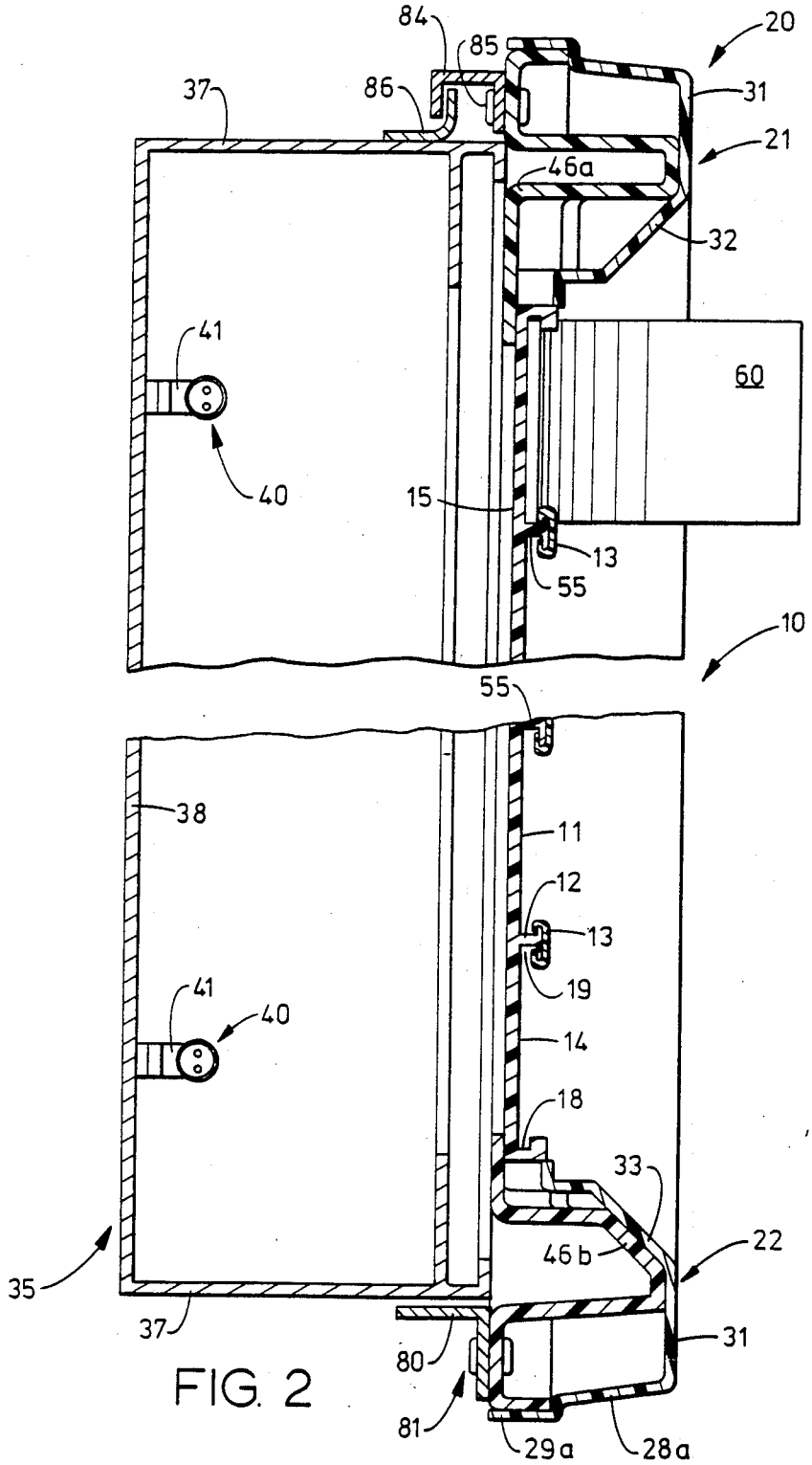
FIG. 2 is a vertical cross sectional view of the sign system of FIG. 1, taken along line 2—2 thereof and having flexible strip 60 inserted in the upper sign track for clarity.
Figures 3, 4:
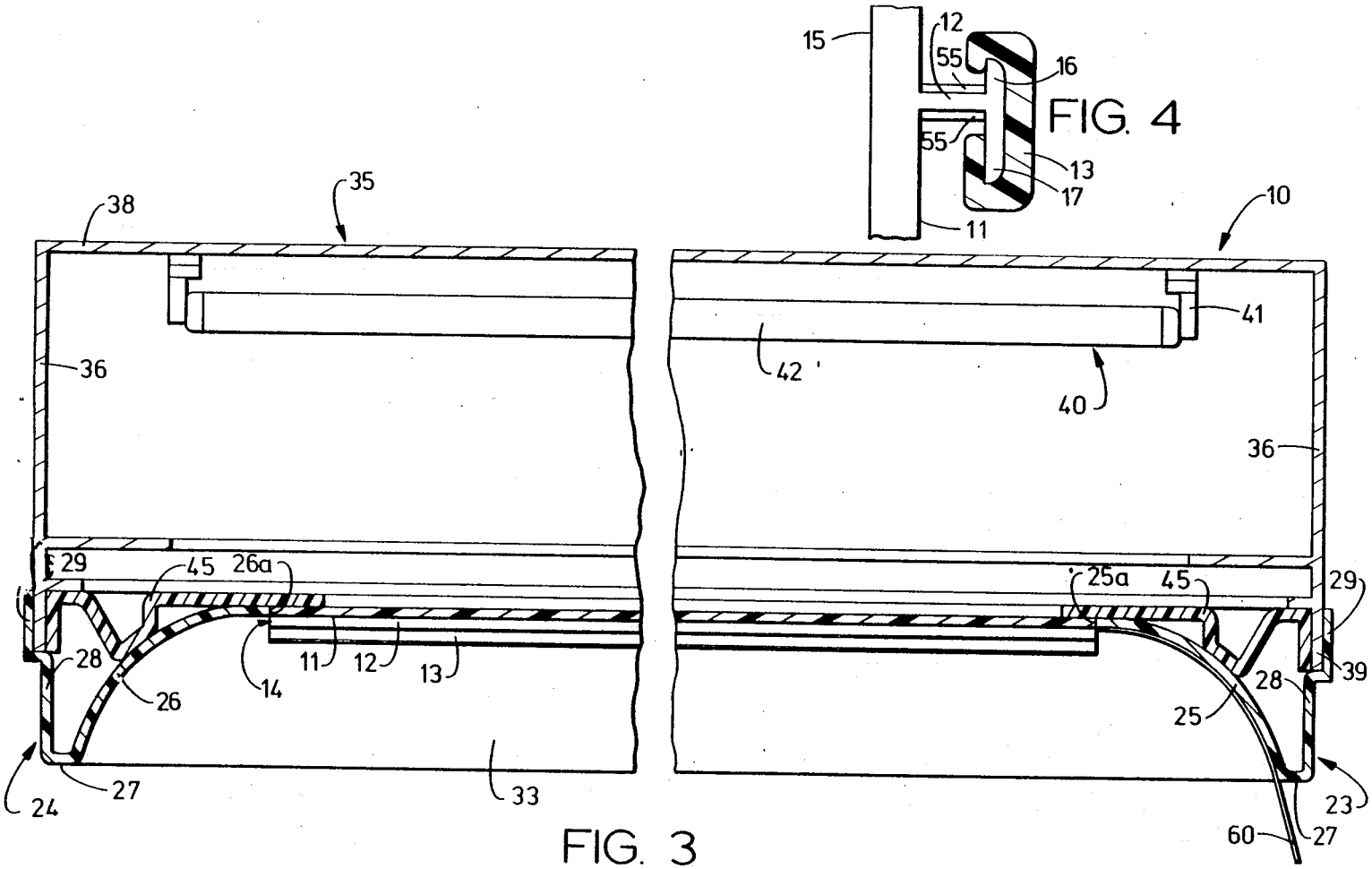
FIG. 3 is a horizontal cross sectional view of the sign of FIG. 1, taken along line 3—3 thereof.
FIG. 4 is a fragmentary end view portion of the sign system shown in FIG. 2, showing additional detail of a preferred embodiment.

As seen best in FIGS. 2 and 3, interchangeable display sign system 10 preferably comprises a sign face 11 having a plurality of vertically spaced longitudinal ribs 12 disposed thereon and extending outwardly from the front of sign face 11, with such ribs preferably including covers or sleeves 13, and defining a plurality of vertically spaced longitudinal tracks 14. Ribs 12 can be attached to sign face 11, or integrally formed therewith. Tracks 14 are intended to receive and support a plurality of indicia elements such as modular digit carriers 50 and flexible display strips 60. In particular, it is contemplated that a preferred display sign system 10 would include a plurality of digit carriers 50 supporting individual digits 51, as well as flexible display strips 60, with the strips 60 and digits 51 being formed of plastic or similar material, with such material being translucent at least in areas where particular alpha-numeric and/or other indicia symbols are to be provided, and being opaque in nature wherever such indicia is not desired. Alternatively, the indicia symbols could be provided as opaque portions, with the remaining area of the material being substantially translucent, as desired. In this way, flexible display strips 60 can provide information to be displayed on display sign system 10 such as menu items, instructions, or other information.

It is quite common in the industry to backlight a display sign or menu sYstem such as shown in FIG. 1 by providing a light source behind the sign panel which can highlight the information, illustrations, and/or other indicia attached adjacent the sign face. An example of a backlighted menu board is shown in U.S. Pat. No. 4,367,604 which was discussed above As used herein, the term "translucent" is understood to mean that a surface permits a major portion of light incident thereon to pass through, and specifically includes transparent surfaces. Similarly, as used herein, the term "opaque" shall be understood to define a surface which blocks a major portion of the light incident thereon. In applications where the sign system is backlighted, it will be understood that individual interchangeable indicia elements (e.g. digit panels 51 or flexible strips 60) may include alpha-numeric indicia or other symbolic indicia or the like which is to be provided as a translucent portion, while the remaining area of the indicia element is substantially opaque, as described above. For example, an opaque layer might be provided to the surface of an interchangeable indicia element by painting, coating, plating or the like. Such opaque coating is omitted or removed to form an alpha-numeric indicia and/or other indicia characters such as letters, numbers, symbols, commas, or the like. Obviously, indicia elements coated completely with an opaque layer or formed of opaque material (i.e. having no indicia formed thereon at all) might also be used to provide an effective blank space between adjacent indicia on a display sign system 10.

It is further anticipated that a plurality of modular digit carriers 50 can be used in conjunction with the flexible display strips 60 to display prices, dates, or other information which is subject to more frequent changes. As described in detail in my copending application entitled "INTERCHANGEABLE SIGN SYSTEM AND MODULAR DIGIT CARRIER THEREFOR", filed concurrently herewith (the disclosure of such copending application being hereby incorporated by reference herein), the modular digit carriers 50 preferably provide for convenient, single direction, uninterrupted motion insertion and removal of interchangeable digit panels 51 from the front surface of display sign system 10, thereby facilitating changes to the information displayed in an efficient manner. However, it should also be understood that the subject display sign system can equally accommodate a wide variety of letter panels, price chip supports or other indicia elements in addition to the modular digit carriers described in the copending application.

Sign face 11 and its spaced longitudinal ribs 12 are preferably formed integrally of transparent material to allow a major portion of light to pass therethrough in order that sign system 10 can be backlighted if desired. It is contemplated that sign face 11 and its longitudinal ribs 12 can be made of acrylic, polymeric or other plastic material, glass, or similar transparent materials; although plastic is preferred for its light weight, durability, and low cost. If opaque covers or sleeves 13 are utilized to cover the cantilevered protuberances or flanges 16 and 17 formed on the distal ends of ribs 12, or if these critical parts of ribs 12 are painted or otherwise coated with opacifying paint or the like, sign face 11 and its longitudinal ribs 12 can be integrally formed of transparent material. Sleeves 13 can be made removable in case a large translucent portion of planar sign face 11 is required to mount a large photographic slide or similar promotional display spanning more than two ribs in vertical height, so that horizontal lines or shadows will not be seen as a result of the opaque sleeves. U.S. Pat. No. 4,367,604, described above, concerns the mounting of such large photographic slides and displays on a backlighted menu board, and provides an example of the type of interchangeable display sign system which might advantageously utilize the present invention. Where removability is not necessary, opaque sleeves might be replaced by any opaque means such as painting or otherwise coating the critical areas of ribs 12 to obviate leakage of backlighting therethrough.

Sign face 11 is illustrated in FIG. 2 as having a back surface 15, and is to be mounted within sign frame 20. Sign frame 20 can comprise top element 21, bottom element 22, and oppositely disposed side frame elements 23 and 24 (see FIGS. 1 and 3). Sign frame 20 can be formed of any appropriate material, and the manner of attachment of sign face 11 to frame 20 is not critical. As best illustrated in FIG. 3, side frame elements 23 and 24 preferably include surfaces 25 and 26, respectively, having a smooth, curved conformation which is substantially flush with the front surface of sign face 11 at the lateral edges of longitudinal tracks 14. Particularly, inner edges **25*a* and 26*a* need not be exactly flush with the lateral edges of sign face 11, however, it is preferred that they be as close to flush as practical in order to facilitate unimpeded insertion and removal of the various information carrying structures and the like into and from the tracks 14 of sign 10**. If these surfaces are not relatively flush, display strips or similar structures may tend to "catch" or be slightlY imPeded during insertion or removal procedures. Providing one or more curved side frame elements which are substantially flush with the sign face allows the structure of the subject invention to facilitate insertion and removal procedures from the front face of the sign, as will be described.

Curved surfaces 25 and 26 flare outwardly and away from the lateral edges of tracks 14 adjacent the inner edges **25*a* and 26*a*, respectively, of surfaces 25 and 26, to provide a relatively smooth cueing surface to facilitate feeding display strips 60 into the ends of longitudinal tracks 14 defined by ribs 12 disposed on sign face 11. Both digit carriers 50 and strips 60 are to be so sized as to be slidably received within a pair of spaced ribs forming a track 14. In this way, front access to changing display sign system 10 is further facilitated, whereby indicia elements such as display strips 60 maY be inserted into the lateral sides of a track 14** by a simple, one direction motion.

As illustrated best in FIG. 3, it is contemplated that the curved side frame member (e.g. 25) might preferably be formed integrally with an outer frame side wall 28 and means for attaching frame side wall 28 to other portions of the display sign system 10. For example, side frame member 25 is shown as being integrally formed with land 27 forming a front face of the frame element 23, and rearwardly disposed side wall 28 having a frame attachment skirt 29 depending from its lower distal portions. Attachment skirt 29 is illustrated only as an example of a means for attaching side frame element 23 to other portions (i.e. sign box housing 35) of such system 10, and could take any variety of forms as dictated by the particular application. Similarly, the manner of attaching sign frame 20 to the peripheral edges of planar sign face 11 is not critical and can be accomplished by a variety of arrangements known or conceivable by one skilled in the art.

An example of a frame adapter/support 45 is illustrated in FIG. 3 as being attached to the rear surface of side frame elements 23 and 24, respectively. Support 45 provides attachment means for connecting frame elements 23 and 24 to the lateral edges of sign face 11 and for connecting the same to other parts of the display sign system such as sign box/housing 35. Again, the exact details of structure and means for attaching sign frame 20 to sign face 11 and other parts of the display sign system 10 are not critical to the present invention, and may be chosen in accordance with the requirements of a particular application.

FIG. 3 further illustrates the substantially flush relationship between the inner abutting edges **25*a* and 26*a* of curved surface 25 and 26, respectively, and sign face 11. This substantially flush arrangement is important for ensuring that insertion and/or removal of indicia elements such as flexible display strips 60 or modular digit carriers 50 can be most easily accomplished without interference and in a single, uninterrupted motion. The smooth curved surfaces 25 and 26 provide convenient cueing or lead-in areas for such indicia elements, while enabling the sign face 11 to be substantially recessed within sign frame 20 to obviate deleterious effects of light leakage around the peripheral edges of sign face 11. Convenient front access for insertion into and removal from sign face 11 of indicia elements allows convenient changing of information displayed on sign system 10 without interfering with business operations and/or requiring any dismantling of the sign system itself. The smooth, curved surfaces 25 and 26 provide a lead-in surface upon which flexible display strip 60 can be conveniently Placed for sliding into a longitudinal track 14 on sign face 11. It has been found that such a curved surface actually provides an advantageous camming action which facilitates insertion of such strips into the longitudinal tracks as the strip is bent inwardly toward track 14 by the curved lead-in surface. The exact radius of curvature of curved surfaces 25 and 26** is not critical, although it is preferred that such radius be substantially constant to provide a smooth cueing surface for the indicia elements.

As illustrated best in FIG. 2, top frame element 21 and bottom frame element 22 do not need the smooth, curved lead-in surface as described with regard to the side frame elements 23 and 24, and can be substantially planar surfaces such as illustrated at 32 and 33, respectively. While surfaces 32 and 33 are shown as being angled slightly away from sign face 11, it is not contemplated that indicia elements (e.g. flexible strips 60 or digit carriers 50) will be inserted or removed in conjunction with either the top frame element 21 or bottom frame element 22, and, consequently, the unique curve lead-in surface need not be provided with such elements. On the other hand, it is contemplated that in some applications, it may be preferred to provide top and bottom frame elements 21 and 22 with curved surfaces for uniformity of appearance with the side frame elements 23 and 24.

As also illustrated in FIG. 2, the top and bottom frame elements 21 and 22 are preferably integrally formed with an outer land 31 connected to the rearwardly depending frame side wall 28a and frame attachment skirt 29a. Side wall 28a and attachment skirt 29a can preferably be formed to correspond with and match frame side wall 28 and attachment skirt 29 of side frame elements 23 and 24. Similarly, top and bottom frame elements 21 and 22 may require frame supports or attachment adapters 46a and 46b to facilitate the arrangement of the frame elements adjacent the top and bottom edges of sign face 11. Support/attachment structures 46a and 46b are illustrated as providing attachment structures for these frame elements both to the sign face 11 and to other portions of the sign system, such as sign housing 35. Supports 46a and 46b are preferably similar to attachment/support adapter 45 described above with regard to side frame elements 23 and 24, and might be attached integrally with other support members, as appropriate. For example, attachment adapter 46a may be bolted to a bracket 84 via bolt 85 to overlap an L-bracket 86 on the upper surface of upper end wall 37; while adapter 46b might be bolted (e.g. bolt 81) to an L-bracket 80 which overlies lower end wall 37. The specific detail of any such attachment arrangements are not critical, and may vary between applications.

The partial end view of FIG. 4 further illustrates angled lead-in chamfers 55 which are preferably formed adjacent the vertically spaced end edges of longitudinal ribs 12. In FIG. 4, sleeve 13 has been trimmed back for clarity, and is consequently shown in cross-section. Lead-in chamfers 55 are contemPlated as comprising angled surfaces providing a tapered lead-in portion for each longitudinal track 14 to facilitate alignment and feeding of indicia elements such as flexible strip 60 into the track grooves 18 and 19 of longitudinal track 14. For example, lead-in chamfers 55 would allow the leading edge of a flexible strip 60 which is slightly misaligned with grooves 18 and 19 of a particular longitudinal track 14 to be directed into track 14 in a substantially fluid motion, and eliminate a need to precisely align strip 60 for insertion procedures. The precise angle and depth of lead-in chamfers 55 is not critical and can be adjusted according to particular applications.

As shown in FIGS. 1 through 3, it is further preferred that in display sign systems including backlighting features, sign system 10 further include a sign box or housing 35 substantially enclosing the rear portions thereof. In particular, sign housing 35 is illustrated as including side walls 36, oppositely disposed upper and lower end walls 37, and back wall 38. Housing 35 is contemplated as comprising a generally open top, box-like structure defined by walls 36 through 38, with the open distal edges of side and end walls 36 and 37 interacting with frame attachment skirt portions 29 and 29a to effectively enclose the back surface 15 of sign face 11. As illustrated in FIGS. 2 and 3, it is also contemplated that one or more light sources (e.g. fluorescent fixtures (41) be provided to backlight sign face 11 and the indicia elements secured thereon. Lighting arrangements 40 are each illustrated as including an elongated fluorescent tube 42 held between a pair of oppositely disposed conventional fluorescent fixture mounts 41, as an example of a light source which may preferably be utilized in display sign system 10.

As can be appreciated, it is contemplated that a longitudinal rib 12 will generally be located closely adjacent the upper and lower peripheral edges of sign face 11, and that opaque sleeves 13 or similar opaque coatings or the like will help obviate any potential light leakage at the abutting interface between top and bottom frame elements 21 and 22 and sign face 11. Moreover, the countersunk or recessed nature of sign face 11 which is enabled by the unique curved surfaces of side frame elements 23 and 24, as described above, further minimizes the potential of observable back-light leakage from about the periphery of sign face 11. Support/attachment adapters 45 and 46 can also be utilized to prevent light leakage about the periphery of sign face 11 by overlapping slightly the abutting edges between sign frame elements 21 through 24 and the peripheral edge of sign face 11, as described above. It is contemplated that in most applications, sign frame 20 will be formed of an opaque material or coated with an opaque surface to provide a darkened border which will help highlight the backlighted sign face 11.

It might also be preferred to provide the curved surfaces 25 and 26 with additional means for facilitating the insertion of indicia elements into individual tracks 14 of sign system 10, in addition to or instead of lead-in chamfers 55 described above. To provide such facilitating means, it is contemplated that the curved surfaces 25 and 26 could be formed with alignment or guide channels or ramps corresponding with and leading into individual longitudinal tracks 14. Such ramps (such as indicated at 70 in FIG. 1) might be provided as raised portions of the curved surfaces 25 and 26, or by the use of small guide rails defining the channels for directing the indicia elements along the smooth, curved surface of the side frame elements and into an aligned longitudinal track 14. The exact shape and size of these additional guide features is not critical and could be customized according to the specific application.

Having shown and described the preferred embodiments of the present invention, further adaptions of the improved display sign system described herein can be accomplished by appropriate modifications by one of ordinary skill in the art without departing from the scope of the present invention. Several of these potential modifications have been enumerated herein, and others will be apparent to those skilled in the art. Accordingly, the scope of the present invention should be considered in terms of the following claims and is understood not to be limited to the details of structure and operation shown and described in the specification and drawings.

I claim:

1. An improved display sign system, said system comprising:

(a) a sign face having oppositely disposed lateral side edges;

(b) a plurality of vertically spaced longitudinal ribs defining at least one longitudinal track disposed on said sign face, said track having lateral edges adjacent said side edges and designed to support indicia elements within said track adjacent said sign face; and (c) at least one side frame member located adjacent a lateral side of said sign face, said frame member comprising a curved surface which is substantially flush with the sign face at said lateral side of said face, and which extends outwardly and away from the lateral side to provide a guide for inserting indicia elements into a lateral edge of a longitudinal track from the front side edge of said sign face.

2. The improved display sign system of claim 1, said system further comprising a pair of side frame members disposed on opposite lateral side edges of said sign face, and wherein each such side frame member comprises a curved surface which is substantially flush with the sign face at the respective lateral side edge, and which extends outwardly and away from such lateral side to provide a guide for inserting indicia elements into a longitudinal track from either front side edge of said sign face.

3. The improved sign system of claim 2, wherein said indicia elements include flexible strips and individual digit carriers designed to slidably fit within a longitudinal track of the sign system.

4. The improved display sign system of claim 2, wherein said indicia elements include flexible strips so sized to slidably fit within a longitudinal track of the sign system.

5. The improved sign system of claim 3, said longitudinal ribs defining said track further comprising said lateral edges into which said flexible strips can be inserted, and wherein said lateral edges include means for facilitating insertion of said flexible strip into said track as said strip is slid along said curved surface.

6. The improved sign system of claim 5, wherein said insertion means comprises a lead-in chamfer on said lateral edges of said ribs.

7. The improved sign system of claim 1, wherein said curved surface of said side frame member further comprises means for aligning indicia elements with a longitudinal track of said system.

8. The improved sign system of claim 7, wherein said means for aligning indicia comprises one or more alignment channels formed on said curved surface.

9. An improved display sign system, said system comprising:

(a) a sign face;

(b) a plurality of vertically spaced longitudinally ribs defining at least one longitudinal track disposed on said sign face, said track designed to support indicia elements adjacent said sign face, said indicia elements including flexible strips sized to slidably fit within a longitudinal track of the sign system; and (c) a pair of side frame members disposed on opposite lateral sides of said sign face, wherein each of such side frame members comprises a curved surface which is substantially flush with the sign face at the respective lateral side, and which extends outwardly and away from such lateral side to provide a guide for inserting indicia elements into a longitudinal track from the front side edge of said sign face, wherein said curved surface of each side frame member provides a cueing surface for feeding said flexible strips into a side edge of a longitudinal track, and wherein said curved surface acts to cam said flexible strip into said track thereby facilitating insertion of said strip thereinto from the front of said sign system.

10. An improved display sign system having a plurality of indicia elements including flexible display strips which can be attached thereon, said system comprising:

(a) a sign face having oppositely disposed lateral side edges;

(b) a plurality of vertically spaced longitudinal ribs defining a plurality of longitudinal tracks located on said sign face, said tracks designed to support indicia elements adjacent said sign face;

(c) a pair of side frame members disposed on opposite lateral sides of said sign face, said frame members each comprising a curved surface which is substantially flush with the sign face at the respective lateral side of said face and which extends outwardly and away from said lateral side, said curved surface providing a cueing surface for facilitating the insertion of said indicia elements and display strips into a side edge of a longitudinal track from the front surface of the sign system.

11. The improved sign system of claim 10, said longitudinal tracks further comPrising lateral edges into which said indicia elements and flexible strips can be inserted, and wherein said lateral edges include means for facilitating insertion of said indicia elements into said track as said elements are slid along said curved surface.

12. The improved sign system of claim 11, wherein said insertion means comprises a lead-in chamfer on said lateral edges of said track.

13. The improved sign system of claim 10, said curved surface of each side frame member further comprising means for aligning indicia elements with a longitudinal track of said system.

14. The improved sign system of claim 13, wherein said means for aligning indicia comprises one or more alignment channels formed on said curved surface.

15. The improved sign system of claim 10, wherein said indicia elements include flexible strips and individual digit carriers designed to slidably fit within a longitudinal track of the sign system.

* * * * *